US005314130A

United States Patent [19]

Wood et al.

[11] Patent Number: 5,314,130

[45] Date of Patent: May 24, 1994

[54] COMBINATION CAPSTAN AND STOWAGE REEL ASSEMBLY FOR ARRAYS TOWED BY SUBMARINES

[75] Inventors: Edwin H. Wood, North Franklin; John P. Tullai, Salem, both of Conn.

[73] Assignee: The United Stats of Americas as represented by the Secretary of the Navy, Washington, D.C.

[21] Appl. No.: 75,369

[22] Filed: Jun. 11, 1993

[51] Int. Cl.[5] ..... B65H 75/34

[52] U.S. Cl. ..... 242/54 R; 254/290

[58] Field of Search ..... 242/54 R, 54 A, 86.5 R, 242/86.5 A, 86.51; 254/290, 291, 292, 293, 382, 383

[56] References Cited

U.S. PATENT DOCUMENTS 4,624,400 11/1986 Zimmer ..... 242/54 A

*Primary Examiner*—John M. Jillions

*Attorney, Agent, or Firm*—Michael J. McGowan; Prithvi C. Lall; Michael F. Oglo

[57] ABSTRACT

A capstan and stowage reel assembly for arrays towed by submarines, the assembly comprising a capstan mounted for rotation about an axis, the capstan having a toothed annular wall and an annular external wall adapted to receive cable/array means thereon, a capstan toothed drive means engaged with the toothed wall to cause the rotation of the capstan, a combination winch/stowage reel mounted for rotation about the axis, the reel having first and second circular flanges adapted to receive the cable/array means therebetween, the first flange having a toothed portion, a reel toothed drive means engaged with the toothed flange to cause the rotation of the reel, and a guide conduit for guiding the cable/array means from the capstan onto the reel in cable/array retrieving operations and from the reel onto the capstan in cable/array means deployment.

10 Claims, 5 Drawing Sheets

COMBINATION CAPSTAN AND STOWAGE REEL ASSEMBLY FOR ARRAYS TOWED BY SUBMARINES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

This invention relates to an assembly for deploying, retrieving and stowing cable and the like, and is directed more particularly to such an assembly as is suitable for use onboard submarines in conjunction with towed acoustical sensing arrays.

2. Description of the Prior Art

Towed arrays are sensitive sensor components of a sonar system that are towed at selected distances behind a submarine and are connected to the submarine by a tow cable. A towed array handling system is used to deploy the array, hold the array at a selected distance from the submarine when deployed, retrieve the array, and stow the array when not deployed.

Referring to FIGS. 1 and 2, it will be seen that a prior art towed array handling system includes a winch assembly W and a stowage reel assembly R. The winch assembly W includes a driven capstan C and an idling drum D. In operation, the capstan C rotates to bring a tow cable T onto the capstan C and thence onto the drum D and back to the capstan, usually for a plurality of turns, and thence onto the stowage reel R. To deploy the tow cable T, which typically would have an array fixed to a free end thereof, the array being of substantially the same configuration as the cable, the capstan C draws cable from the stowage reel R and, after a plurality of turns around the idling drum D, urges the cable through a guide tube G and out of the submarine to facilitate towing of the array well aft of the submarine's propulsion propellers. The capstan is driven at its central hub. In paying out the cable there initially may be little stress on the cable so that the capstan may turn within the cable wound thereon without causing the cable to deploy out. Rollers are provided (not shown) which press the cable wound upon the capstan against the capstan hub to generate a frictional interface so that turning of the capstan hub will generate movement of the cable. In short order, enough cable is deployed such that the drag of the array and cable through the water produces strain on the cable sufficient to cause the cable to move in accordance with the bidding of the capstan.

It is clear from FIGS. 1 and 2, that the equipment arrangement dictated by the prior art assembly requires a relatively large space on a vessel in which space is at a premium. It would be beneficial to have available for use in submarines a winch and stowage reel assembly more volume and weight efficient than the above-described prior art apparatus.

Further, new arrays are of cross sections and sizes, and of complex configurations, which are not compatible with the above-described capstan traction rollers and small diameter capstan and idler drums, and their close tolerances relative to the prior art cable and array.

SUMMARY OF THE INVENTION

It is therefore an object of the present invention to provide a combination capstan and stowage reel assembly requiring substantially less space and of less weight than the prior art assembly.

A further object of the invention is to provide such an assembly adapted to handle, optionally, towed assemblies consisting of either one or several arrays towed by a single tow cable.

A still further object is to provide such an assembly capable of less stressful handling of cables and arrays by the use of large diameter tensioning, guides and storage components.

Another object is to provide such an assembly which is less costly than the prior art apparatus.

With the above and other objects in view, as will hereinafter appear, a feature of the present invention is the provision of a combination capstan and stowage reel assembly for arrays towed by submarines, the assembly comprising a capstan mounted for rotation about an axis, the capstan having a toothed annular internal wall and an annular external wall adapted to receive cable/array means thereon, a capstan drive motor having a toothed drive spindle engaged with the toothed wall to cause the rotation of the capstan, a combination winch/stowage reel mounted for rotation about the same axis, the reel having first and second circular flanges adapted to receive the cable/array means therebetween, the first flange having a toothed outer edge, a reel drive motor having a toothed drive spindle engaged with the toothed first flange edge to cause the rotation of the first flange, and guide means for guiding the cable/array means from the capstan onto the reel in cable/array means retrieving operations and from the reel onto the capstan in cable/array means deployment operations.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
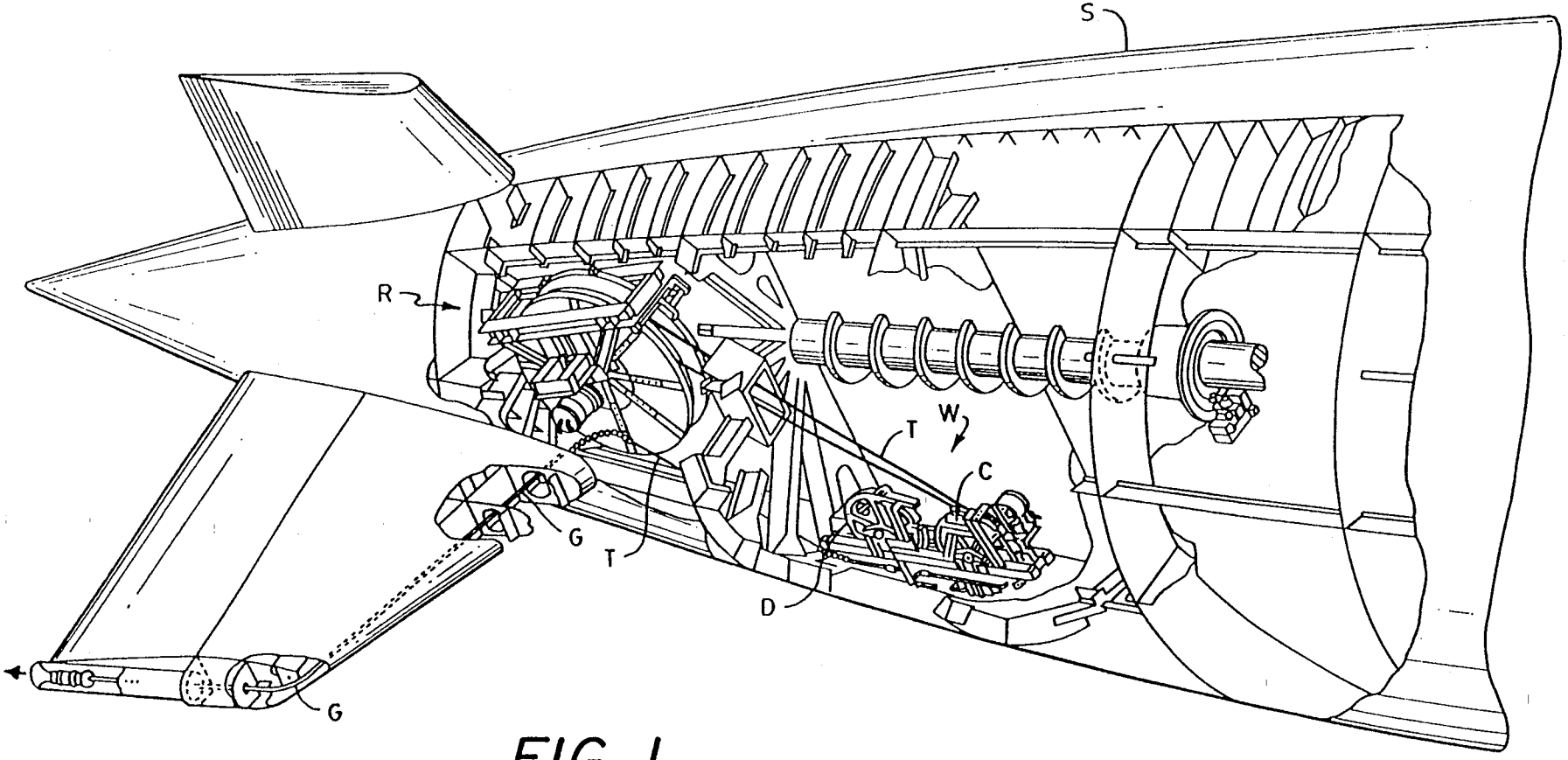
FIG. 1 PRIOR ART
FIG. 1 is a perspective view of a prior art assembly, showing the disposition of a winch portion and a stowage reel portion of the assembly in a submarine.
Figure 2:
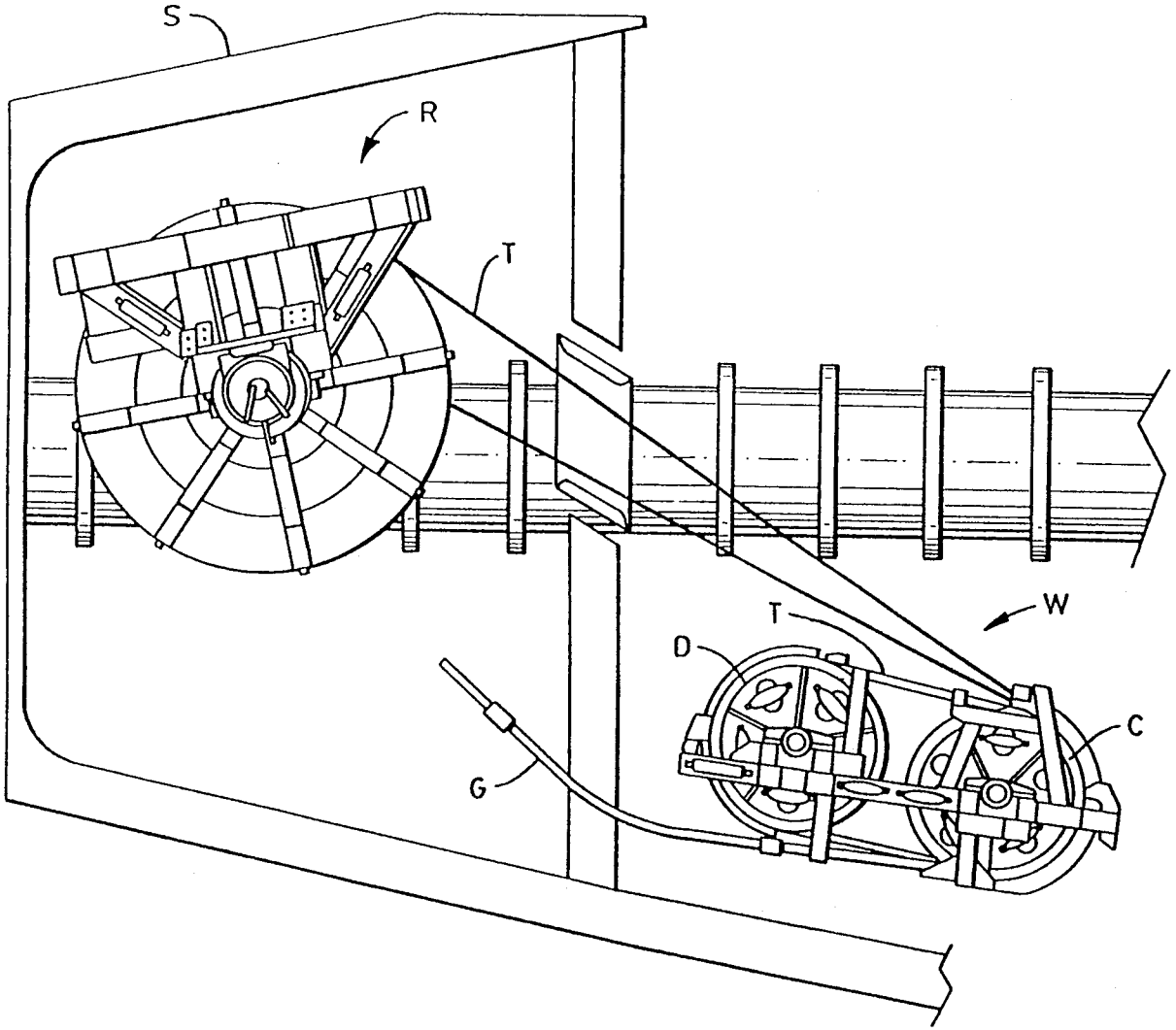
FIG. 2 PRIOR ART
FIG. 2 is a side elevational view of the prior art assembly shown in FIG. 1.
Figure 3:
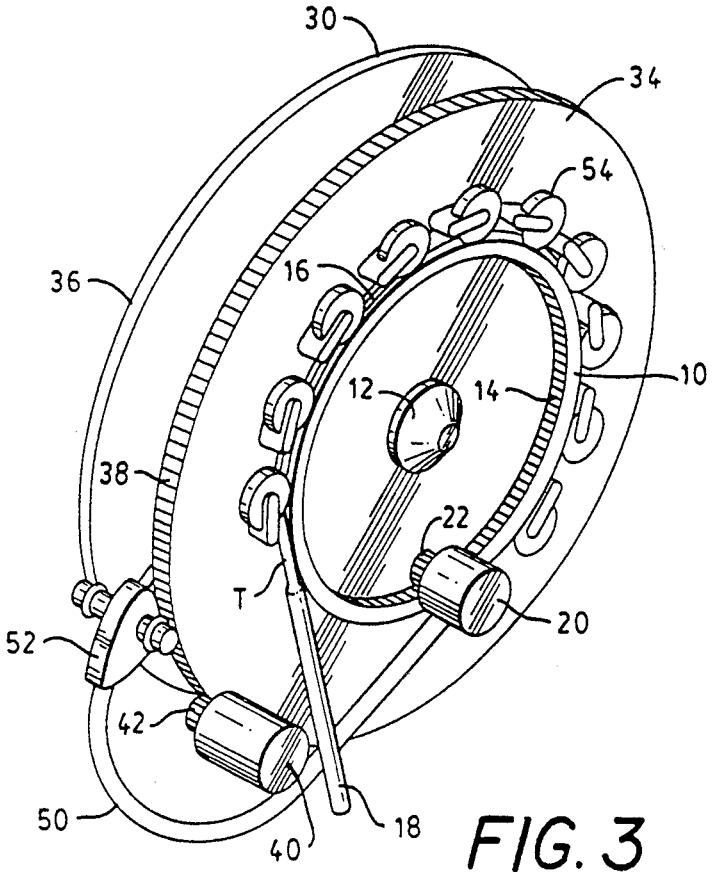
FIG. 3 is a perspective view of a combination capstan and winch/stowage reel assembly illustrative of an embodiment of the invention.
Figure 4:
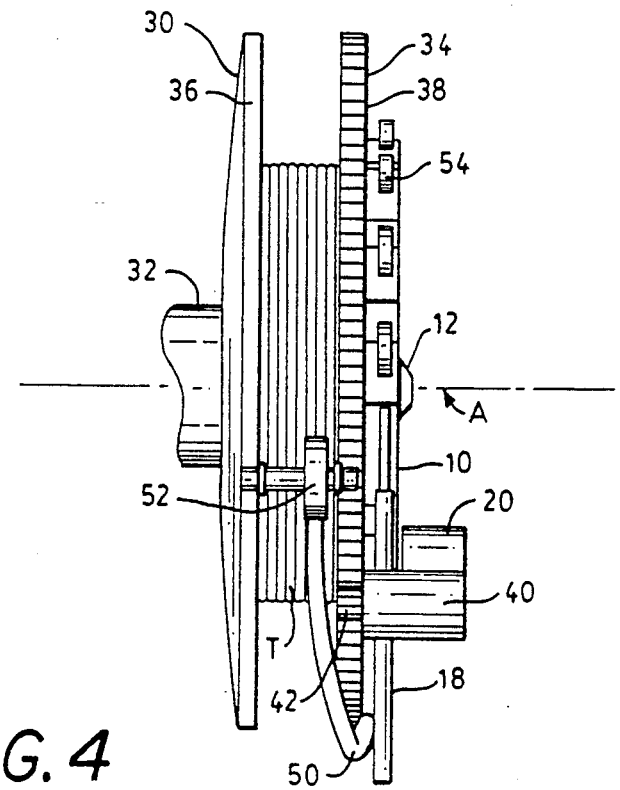
FIG. 4 is an end view of the assembly of FIG. 3.
Figure 5:
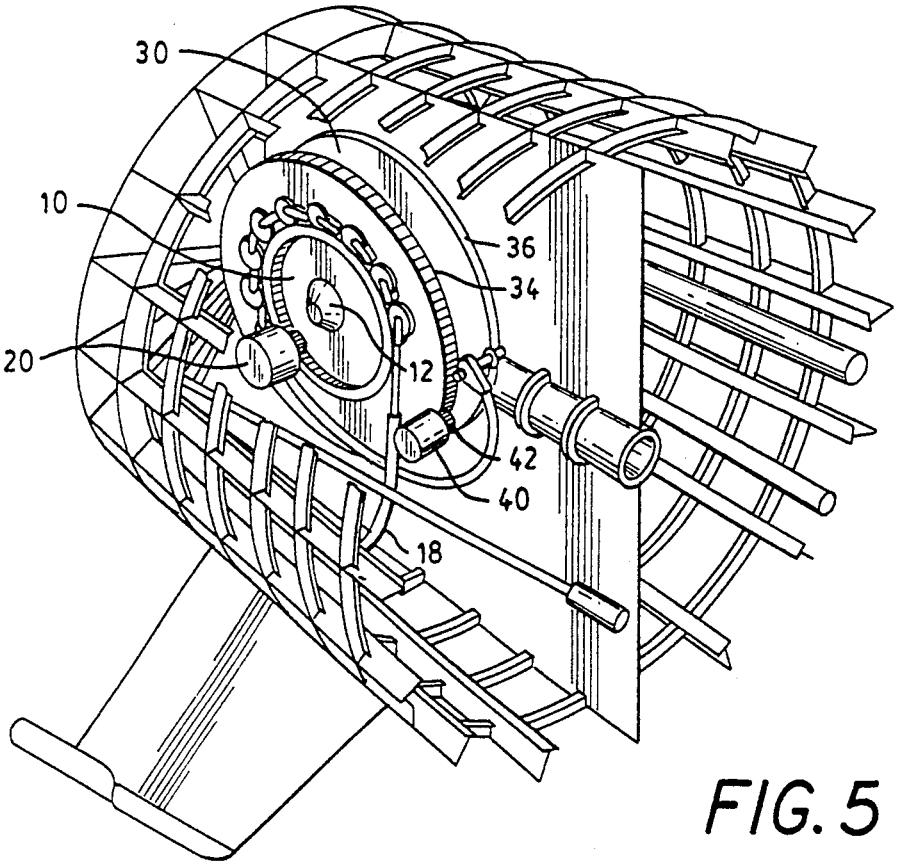
FIG. 5 is a perspective view of the assembly of FIG. 3 in place in a submarine.
Figure 6:
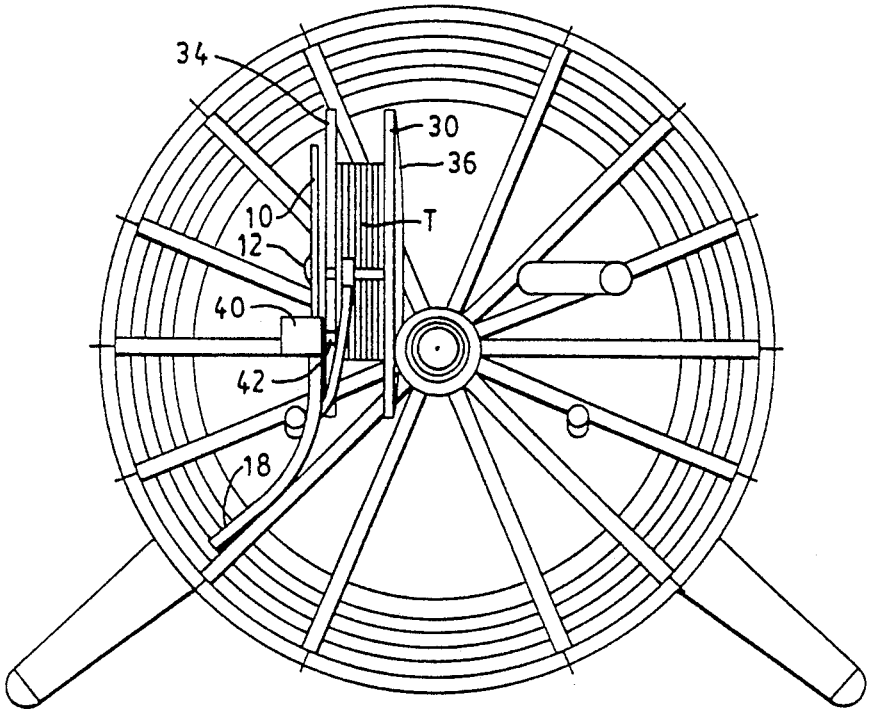
FIG. 6 is an end view of the assembly of FIG. 4 in place in a submarine.

Referring to FIGS. 3 and 4, it will be seen that an illustrative assembly includes a capstan 10 mounted on an axle 12 for rotation about an axis A. The capstan 10 is provided with a toothed annular internal wall 14 (FIG. 3) and an annular external wall 16 comprising an endless groove on the periphery of the capstan. The external wall 16 is adapted to receive cable and array means fed to capstan 10 by a conduit 18 extending from guide tube G of the type shown in FIGS. 1 and 2.

A capstan drive motor 20 is provided having a toothed drive spindle 22 (FIG. 3) engaged with capstan internal wall 14, such that by operation of drive motor 20, drive spindle 22 is caused to rotate and thereby cause rotation of capstan 10.

The assembly further includes a combination winch and stowage reel 30 mounted on an axle 32 (FIG. 4) for rotation about axis A. The reel 30 includes first and second circular flanges 34, 36 adapted to receive therebetween cable and array means T. The first 34 of the two flanges is provided with a toothed outer edge 38.

A reel drive motor 40 is provided having a toothed drive spindle 42 engaged with first flange toothed edge 38 of reel 30. By operation of motor 40, drive spindle 42 is caused to rotate and thereby cause rotation of reel 30.

A guide means 50 is provided for guiding cable/array means T from capstan 10 onto reel 30 in a cable/array means retrieving operation, and for guiding cable/array means T from reel 30 onto capstan 10 in a deployment operation. Guide means 50 may be a rollerized tube or other structure extending from the tangential periphery of capstan 10 to a point on reel 30 between flanges 34 and 36. At the end of guide means 50, proximate reel 30, there may be disposed either a passively motivated or actively motivated level wind or cable distributing device 52, which insures that the cable T is wound evenly on the reel 30.

The capstan 10 is provided with push rollers 54 which are spring biased toward the capstan external wall 16 to force the cable/array means T onto the capstan surface, increasing the traction between the capstan and cable. The push rollers 54 and the guide means 50 are mounted on a static frame member (not shown).

The capstan toothed internal wall 14 and reel first flange 34 may be of a composite construction (not shown) wherein a metal gear of large dimensional tolerance is sandwiched between non-metallic gears of small dimensional tolerance, or interference fit, with the metallic drive spindles 22, 42. In normal operation, the metallic drive spindles engage the non-metallic gear surfaces. However, upon occurrence of overload situations, the metallic gears sustain the overload. This structure produces low noise power transfer at low operational speeds. This gear structure is shown and described in U.S. Pat. Application Ser. No. 07/888,997, filed 26 May 1992, in the name of Edwin H. Wood.

In operation, to retrieve a deployed cable/array means, the capstan drive motor 20 and the reel drive motor 40 are started, causing separate rotation of capstan 10 and reel 30 about axis A. Cable/array means T is drawn through the guide tube G and conduit 18 onto capstan 10, the rollers 54 bearing down on the cable T to increase traction between the capstan and cable. After passing through the conduit 18, the cable wraps approximately 260 degrees around the capstan and transitions from the capstan to reel 30 via guide means 50. The level wind device may be actively actuated to distribute the cable evenly over the spool of the reel or may be passively motivated by cable bias to allow free laying of cable over the spool. To deploy the cable, the system operates in reverse order.

Figure 7:
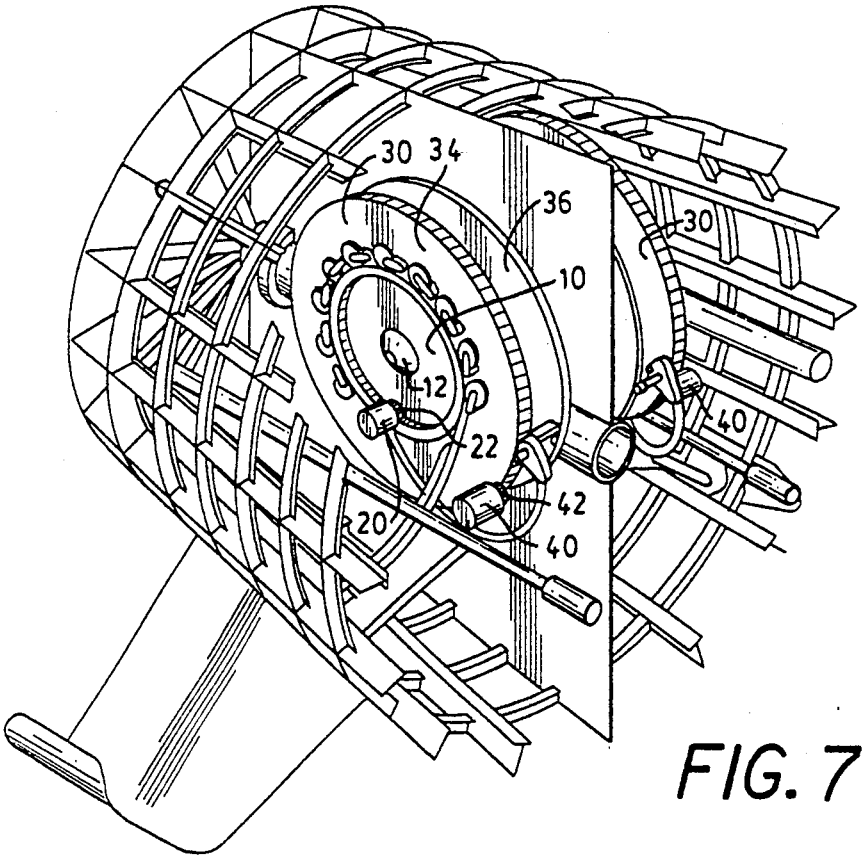
FIGS. 7 and 8 are, respectively, perspective and end views of two assemblies in place in a submarine.
Figure 8:
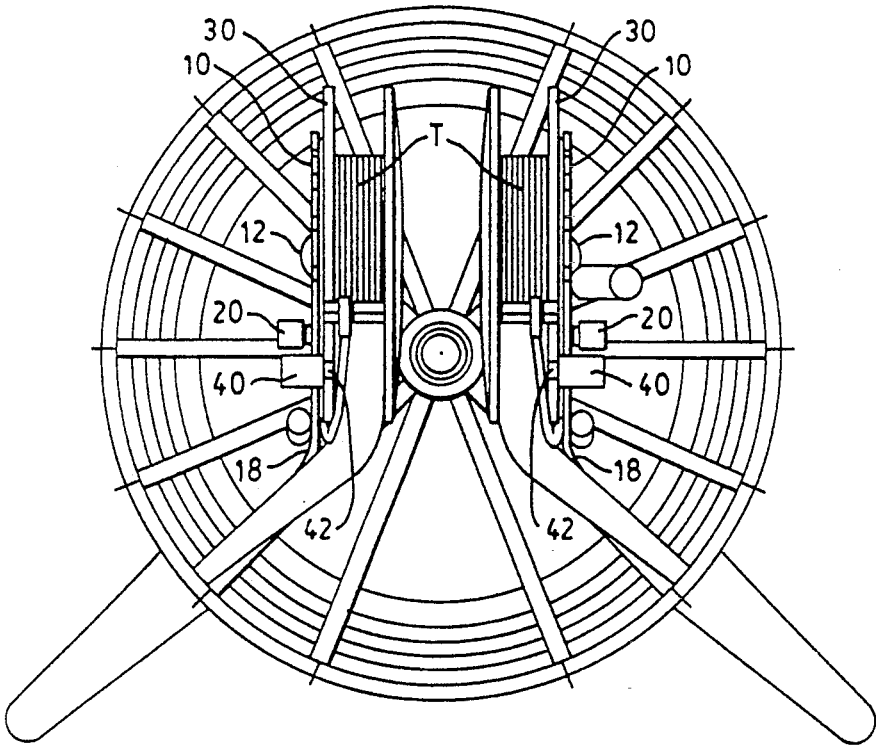

As may be seen in FIGS. 7 and 8, more than one assembly, as described above, may be mounted in the after portion of a submarine, such that more than one type or configuration of array may be handled simultaneously.

There is thus provided a single unit array handling assembly which is substantially more efficient from volume, weight, and cost standpoints than current assemblies.

It is to be understood that the present invention is by no means limited to the particular construction herein disclosed and/or shown in the drawings, but also comprises any modifications or equivalents within the scope of the claims. For example, while the reel normally provides low tension array storage when used with the capstan, as described above, the reel may additionally provide primary inhaul force as a winch, as in use of configurationally complex arrays. A second traction means (not shown), such as powered pusher rollers, may be used in conjunction with the winch to assist in deployment directly from the reel. The scale of subject device may be altered to accommodate other towing platforms, arrangements and towed assembly sizes and configurations.

What is claimed is:

1. A capstan and stowage reel assembly for arrays towed by submarines, the assembly comprising:

a capstan mounted for rotation about an axis, said capstan having an annular toothed wall and an annular external wall adapted to receive cable/array means thereon;

toothed capstan drive means engaged with said toothed wall to cause said rotation of said capstan;

a combination winch/stowage reel mounted for rotation about said axis, said reel having first and second circular flanges adapted to receive said cable/array means therebetween, said first flange having a toothed portion;

a reel drive means threadedly engaged with said toothed portion of said reel to cause said rotation of said first flange and thereby rotation of said reel; and guide means extending from proximate said capstan to proximate said reel for facilitating transition of said cable/array means between said capstan and said reel.

2. The assembly in accordance with claim 1 wherein said capstan annular external wall comprises an endless peripheral groove adapted to receive said cable/array means.

3. The assembly in accordance with claim 1 wherein said capstan drive means comprises gear means threadedly engaged with said capstan toothed wall.

4. The assembly in accordance with claim 3 wherein said capstan toothed wall comprises an internal wall of said capstan.

5. The assembly in accordance with claim 1 wherein space between said first and second flanges is equal to a plurality of diameters of said cable/array means, said assembly further including a level wind device adapted to guide said cable/array means evenly onto said reel.

6. The assembly in accordance with claim 1 wherein said reel drive means comprises toothed gear means engaged with said toothed portion of said reel.

7. The assembly in accordance with claim 6 wherein said toothed portion of said reel comprises a toothed edge of said first flange.

8. The assembly in accordance with claim 1 wherein said guide means comprises a conduit extending from proximate the periphery of said capstan to proximate the periphery of said reel, said conduit being adapted to support sliding movement of said cable/array means therethrough.

9. The assembly in accordance with claim 8 wherein said reel is adapted to receive said cable/array means such that portions of said cable/array means are disposed side-by-side on said reel, said assembly further including a level wind device adapted to guide said cable/array means from said conduit onto said reel in evenly disposed side-by-side fashion.

10. A capstan and stowage reel assembly for arrays towed by submarines, the assembly comprising:

a capstan mounted for rotation about an axis, said capstan having a toothed annular internal wall and an annular external wall adapted to receive cable/array means thereon;

a capstan drive motor having a toothed drive spindle engaged with said toothed wall to cause said rotation of said capstan;

a combination winch/stowage reel mounted for rotation about said axis, said reel having first and second circular flanges adapted to receive said cable/array means therebetween, said first flange having a toothed outer edge;

a reel drive motor having a toothed drive spindle engaged with said toothed first flange to cause said rotation of said first flange; and guide means for guiding said cable/array means from said capstan onto said reel in cable/array retrieving operations and from said reel onto said capstan in cable/array means deployment.

* * * * *